US010274862B2

(12) United States Patent
Iriyama et al.

(10) Patent No.: US 10,274,862 B2
(45) Date of Patent: Apr. 30, 2019

(54) IMAGE FORMING APPARATUS INCLUDING DRUM CARTRIDGE

(71) Applicant: Brother Kogyo Kabushiki Kaisha, Nagoya-shi, Aichi-ken (JP)

(72) Inventors: Shota Iriyama, Toyokawa (JP); Masatoshi Shiraki, Nagoya (JP); Mayu Wakamatsu, Inazawa (JP); Keigo Nakajima, Nagoya (JP); Kei Katagiri, Nagoya (JP)

(73) Assignee: Brother Kogyo Kabushiki Kaisha, Nagoya-shi, Aichi-Ken (JP)

( * ) Notice: Subject to any disclaimer, the term of this patent is extended or adjusted under 35 U.S.C. 154(b) by 0 days.

(21) Appl. No.: 16/026,119

(22) Filed: Jul. 3, 2018

(65) Prior Publication Data

US 2019/0011851 A1 Jan. 10, 2019

(30) Foreign Application Priority Data

Jul. 4, 2017 (JP) ..... 2017-131479

(51) Int. Cl.
*G03G 15/08* (2006.01)
*G03G 15/04* (2006.01)
*G03G 15/20* (2006.01)

(52) U.S. Cl.
CPC ... *G03G 15/0808* (2013.01); *G03G 15/04072* (2013.01); *G03G 15/087* (2013.01); *G03G 15/2064* (2013.01)

(58) Field of Classification Search
CPC ..... G03G 15/0808; G03G 15/087; G03G 15/04072; G03G 15/2064
See application file for complete search history.

(56) References Cited

U.S. PATENT DOCUMENTS 6,643,481 B2 * 11/2003 Higeta ..... G03G 21/181 399/106
7,054,578 B2 * 5/2006 Jung ..... G03G 21/1647 399/110
7,321,739 B1 * 1/2008 Dawson ..... G03G 21/1846 222/DIG. 1
7,720,408 B2 * 5/2010 Ueno ..... G03G 21/1832 399/103
8,290,395 B2 * 10/2012 Uchida ..... G03G 21/1839 399/110

(Continued)

FOREIGN PATENT DOCUMENTS

JP 2006-064835 A 3/2006
JP 2015-138107 A 7/2015
JP 2017-058517 A 3/2017

*Primary Examiner* — David J Bolduc
(74) *Attorney, Agent, or Firm* — Banner & Witcoff, Ltd.

(57) ABSTRACT

There is provided an image forming apparatus including: a casing having a drum guide and a developing guide, a drum cartridge having a photosensitive drum and a handle, and a developing cartridge having a developing roller. The developing guide is longer than the drum guide. With the drum cartridge being installed in the casing and with the developing cartridge being removed from the casing, the handle locates at the first position. Further, with the drum cartridge and the developing cartridge being installed in the casing, being pressed by the developing cartridge, the handle locates at the second position farther away from an opening than the first position.

17 Claims, 15 Drawing Sheets

(56) References Cited

U.S. PATENT DOCUMENTS 8,761,634 B2 * 6/2014 Mori ..... G03G 21/1846 399/113
9,046,871 B2 * 6/2015 Suzuki ..... G03G 21/1842
9,244,428 B2 1/2016 Matsumaru
2003/0091361 A1 * 5/2003 Noda ..... G03G 21/1871 399/90
2006/0029418 A1 * 2/2006 Ishii ..... G03G 21/1857 399/111
2006/0045567 A1 * 3/2006 Ahn ..... G03G 15/0896 399/111
2006/0140681 A1 * 6/2006 Yamane ..... G03G 21/1647 399/258
2006/0245786 A1 * 11/2006 Suzuki ..... G03G 21/1821 399/111
2006/0257163 A1 * 11/2006 Sato ..... G03G 21/1821 399/111
2008/0317499 A1 * 12/2008 Nishimura ..... G03G 21/1821 399/112
2009/0317133 A1 * 12/2009 Nishimura ..... G03G 21/1623 399/119
2011/0064463 A1 * 3/2011 Hashimoto ..... G03G 21/1846 399/119
2011/0274462 A1 * 11/2011 Kim ..... G03G 21/1846 399/119
2011/0299882 A1 * 12/2011 Tanaami ..... G03G 15/326 399/110
2012/0219317 A1 * 8/2012 Kato ..... G03G 15/0189 399/110
2013/0051847 A1 * 2/2013 Kamimura ..... G03G 15/757 399/111
2014/0086625 A1 * 3/2014 Itabashi ..... G03G 21/1842 399/111
2015/0139689 A1 * 5/2015 Suzuki ..... G03G 21/1842 399/110
2015/0205256 A1 7/2015 Matsumaru
2016/0041519 A1 * 2/2016 Sato ..... G03G 21/1633 399/113
2016/0231698 A1 * 8/2016 Miyoshi ..... G03G 21/1842
2016/0291506 A1 * 10/2016 Sato ..... G03G 15/0812
2017/0075292 A1 3/2017 Nagae et al.
2017/0269504 A1 * 9/2017 Abe ..... G03G 21/1821

* cited by examiner

IMAGE FORMING APPARATUS INCLUDING DRUM CARTRIDGE

CROSS REFERENCE TO RELATED APPLICATION

The present application claims priority from Japanese Patent Application No. 2017-131479 filed on Jul. 4, 2017, the disclosure of which is incorporated herein by reference in its entirety.

BACKGROUND

Field of the Invention

The present disclosure relates to image forming apparatuses including a drum cartridge.

Description of the Related Art

Conventionally, there are known image forming apparatuses which include a casing, a drum cartridge and a developing cartridge, and have such characteristics as below.

The casing has an opening. The drum cartridge is installable into the casing through the opening. The drum cartridge has a photosensitive drum. The developing cartridge is installable into the casing through the opening, independent from the drum cartridge. The developing cartridge has a developing roller.

SUMMARY

In the image forming apparatus described above, the drum cartridge and the developing cartridge are installed in the casing. A user is allowed to have a view of both the drum cartridge and the developing cartridge through the opening.

However, when the user is to preferentially remove the developing cartridge which has a high replacing frequency, it is possible for him/her to mistakenly remove the drum cartridge from the casing.

Hence, an object of the present disclosure is to provide an image forming apparatus capable of reliably selecting the developing cartridge and removing the same with the drum cartridge and the developing cartridge being installed in the casing.

An image forming apparatus according to the present disclosure includes a casing, a drum cartridge, and a developing cartridge.

The casing includes a drum guide and a developing guide. The developing guide is longer than the drum guide. The casing has an opening.

The drum cartridge is installable into the casing through the opening by the drum guide guiding the drum cartridge. The drum cartridge includes a photosensitive drum and a handle. The handle is movable between a first position and a second position.

The developing cartridge is installable into the casing through the opening by the developing guide guiding the developing cartridge. The developing cartridge is removable from the casing through the opening. The developing cartridge includes a developing roller.

In a case that the drum cartridge is installed in the casing and that the developing cartridge is removed from the casing, the handle locates at the first position. In a case that the drum cartridge and the developing cartridge are installed in the casing, the handle locates at the second position farther away from the opening than the first position, by being pressed by the developing cartridge.

According to such a configuration, in a case that the drum cartridge and the developing cartridge are installed in the casing, the handle of the drum cartridge is located at the second position by the developing cartridge, and thus moved away from the opening.

Therefore, when a user has a view of the inside of the casing through the opening, the user can find the handle of the drum cartridge less readily.

By virtue of this, in a case that the drum cartridge and the developing cartridge are installed in the casing, it is possible to draw the user's attention to the developing cartridge but not to the handle of the drum cartridge.

As a result, in a case that the drum cartridge and the developing cartridge are installed in the casing, the user can reliably select the developing cartridge and remove the developing cartridge.

DESCRIPTION OF THE EMBODIMENTS

<Image Forming Apparatus 1>

An outline of an image forming apparatus 1 will be explained below.

Figure 1:
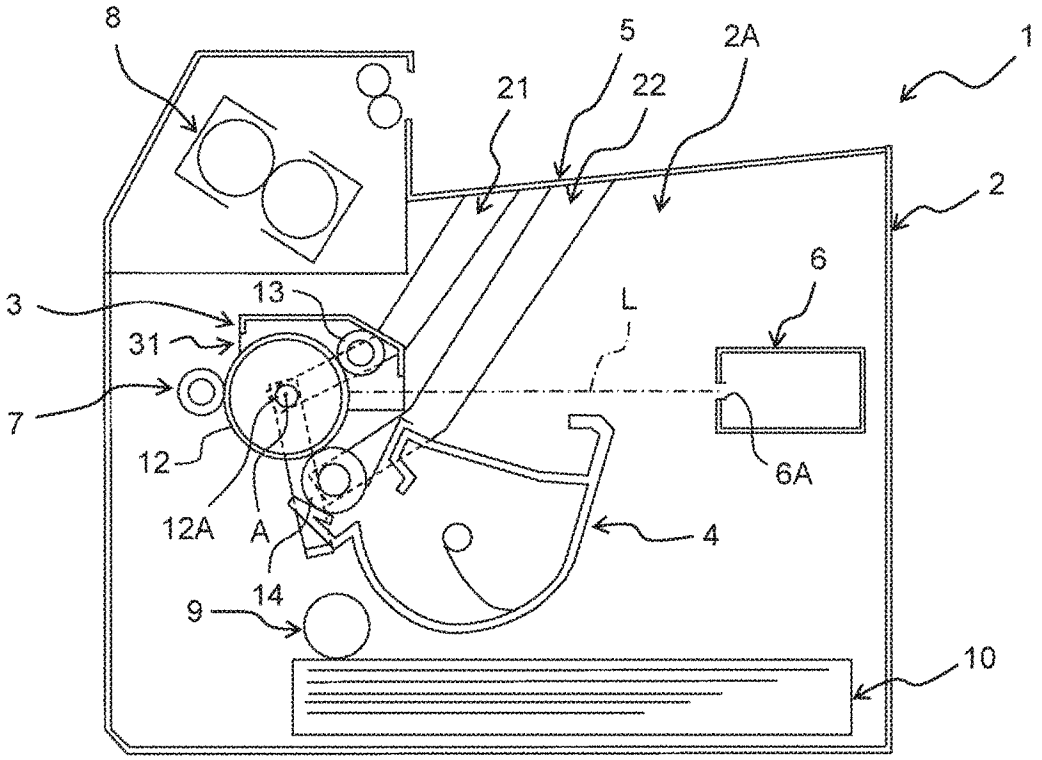
FIG. 1 is a schematic configuration diagram of an image forming apparatus.

As depicted in FIG. 1, the image forming apparatus 1 includes a (main) casing 2, a drum cartridge 3, and a developing cartridge 4.

The casing 2 has an opening 2A for installing the drum cartridge 3 and the developing cartridge 4 into the casing 2. The opening 2A is used in installing the drum cartridge 3 into the casing 2. Further, the opening 2A is also used in installing the developing cartridge 4 into the casing 2. The casing 2 includes a cover 5, an exposure unit 6, a transfer roller 7, a fixing unit 8, a paper feed unit 9, and a paper feed tray 10.

The cover 5 is movable between an opened position to uncover the opening 2A (see FIG. 2) and a closed position to cover the opening 2A (see FIG. 1). The cover 5 is a top cover positioned at the upper end of the casing 2. The cover 5 is positioned above the exposure unit 6.

The exposure unit 6 is provided to expose the surface of a photosensitive drum 12. The photosensitive drum 12 will be explained later on. The exposure unit 6 is a laser scanning unit. The exposure unit 6 has an emission port 6A for emitting light L. The light L emitted from the emission port 6A falls on the surface of the photosensitive drum 12 after passing below a charging roller 13 and above the developing cartridge 4. The charging roller 13 will be explained later on.

The transfer roller 7 is provided to transfer toner image formed on the surface of the photosensitive drum 12 to printing paper. The transfer roller 7 is in contact with the surface of the photosensitive drum 12 with the drum cartridge 3 being installed in the casing 2.

The fixing unit 8 is provided to fix the toner image on the printing paper by way of heating and pressurizing the printing paper with the transferred toner image. The printing paper having passed through the fixing unit 8 is discharged onto the cover 5.

The paper feed unit 9 is configured to supply the printing paper in the paper feed tray 10 between the photosensitive drum 12 and the transfer roller 7.

The paper feed tray 10 is provided to accommodate the printing paper.

The drum cartridge 3 is installable into the casing 2 through the opening 2A. The drum cartridge 3 includes the photosensitive drum 12 and the charging roller 13.

The photosensitive drum 12 is rotatable about a rotation axis A extending in an axial direction. The photosensitive drum 12 includes a drum shaft 12A extending along the rotation axis A.

The charging roller 13 is provided to electrically charge the surface of the photosensitive drum 12. The charging roller 13 is in contact with the surface of the photosensitive drum 12.

The developing cartridge 4 is installable into the casing 2 through the opening 2A. The developing cartridge 4 is removable from the casing 2 through the opening 2A. The developing cartridge 4 is installable into or removable from the casing 2 independently from the drum cartridge 3. The developing cartridge 4 accommodates toner. The developing cartridge 4 includes a developing roller 14.

The developing roller 14 is provided to supply the toner to the photosensitive drum 12. The developing roller 14 is positioned below the drum shaft 12A with the drum cartridge 3 and the developing cartridge 4 being installed in the casing 2. In other words, with the drum cartridge 3 and the developing cartridge 4 being installed in the casing 2, the distance between the cover 5 and the developing roller 14 along an up/down direction is longer than the distance between the cover 5 and the drum shaft 12A along the up/down direction. With the drum cartridge 3 and the developing cartridge 4 being installed in the casing 2, the developing roller 14 is in contact with the surface of the photosensitive drum 12.

<The Casing 2>

Next, details of the casing 2 will be explained.

Figure 2:
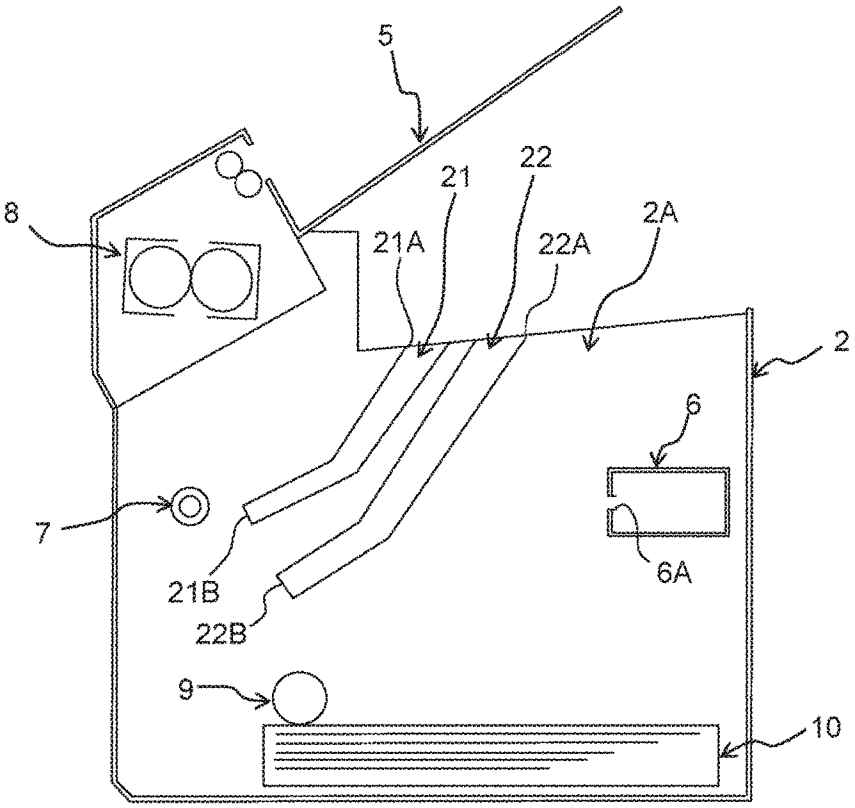
FIG. 2 is an explanatory diagram for explaining the casing depicted in FIG. 1.

As depicted in FIG. 2, the casing 2 includes a drum guide 21 and a developing guide 22.

The drum guide 21 guides the drum cartridge 3 to the position for the photosensitive drum 12 to contact with the transfer roller 7 when the drum cartridge 3 (see FIG. 1) is installed into the casing 2. That is, being guided by the drum guide 21, the drum cartridge 3 is installable into the casing 2 through the opening 2A. The drum guide 21 is positioned at the inner surface of the casing 2 along the axial direction. The drum guide 21 extends in a drum installation direction. The drum installation direction is the direction along which the drum cartridge 3 moves when the drum cartridge 3 is installed into the casing 2. The drum guide 21 has an upstream end 21A and a downstream end 21B along the drum installation direction. The upstream end 21A is positioned between the cover 5 and the downstream end 21B along the drum installation direction, with the cover 5 being positioned at the closed position. The downstream end 21B is positioned between the transfer roller 7 and the exposure unit 6 along a horizontal direction.

The developing guide 22 guides the developing cartridge 4 to the position for the developing roller 14 to contact with the photosensitive drum 12 when the developing cartridge 4 (see FIG. 1) is installed into the casing 2. That is, being guided by the developing guide 22, the developing cartridge 4 is installable into the casing 2 through the opening 2A. The developing guide 22 is positioned at the inner surface of the casing 2 along the axial direction. The developing guide 22 extends in a developing cartridge installation direction. The developing cartridge installation direction is the direction along which the developing cartridge 4 moves when the developing cartridge 4 is installed into the casing 2. The developing guide 22 is longer than the drum guide 21. The developing guide 22 has an upstream end 22A and a downstream end 22B along the developing cartridge installation direction. The upstream end 22A is positioned between the cover 5 and the downstream end 22B along the developing cartridge installation direction, with the cover 5 being positioned at the closed position. The downstream end 22B is positioned below the downstream end 21B of the drum guide 21. The downstream end 22B is positioned near the paper feed unit 9 than the downstream end 21B. The downstream end 22B is positioned near the paper feed tray 10 than the downstream end 21B. The downstream end 21B is positioned near the transfer roller 7 than the downstream end 22B. The downstream end 21B is positioned near the fixing unit 8 than the downstream end 22B. The downstream end 21B is positioned near the cover 5 at the closed position than the downstream end 22B in the up-down direction. The upstream end 21A and the upstream end 22A may be positioned between the cover 5 at the closed position and the exposure unit 6 in the up-down direction. Even in this case, the developing guide 22 is longer than the drum guide 21.

<The Drum Cartridge 3>

Next, details of the drum cartridge 3 will be explained.

Figure 3:
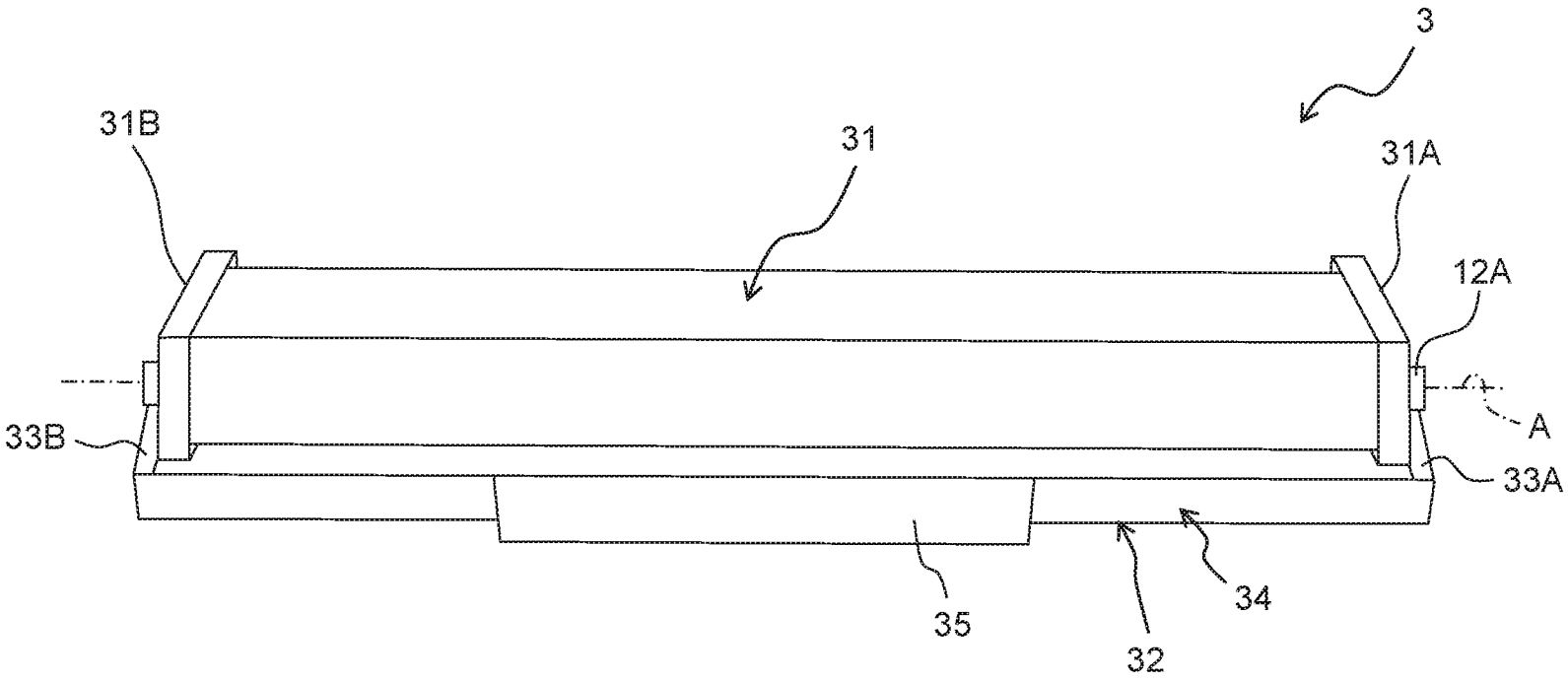
FIG. 3 is a perspective view of the drum cartridge depicted in FIG. 1.

As depicted in FIG. 3, the drum cartridge 3 includes the aforementioned photosensitive drum 12 (see FIG. 1), the aforementioned charging roller 13 (see FIG. 1), a drum frame 31, and a handle 32.

The drum frame 31 accommodates the photosensitive drum 12 and the charging roller 13. The drum frame 31 extends in the axial direction. The drum frame 31 has a cylindrical shape. The drum frame 31 includes a first side plate 31A and a second side plate 31B along the axial direction.

The first side plate 31A supports one end of the photosensitive drum 12 along the axial direction. In detail, the first side plate 31A rotatably supports one end of the drum shaft 12A along the axial direction.

The second side plate 31B is spaced from he first side plate 31A along the axial direction. The second side plate 31B supports the other end of the photosensitive drum 12 along the axial direction. In detail, the second side plate 31B rotatably supports the other end of the drum shaft 12A along the axial direction. With the first side plate 31A supporting the one end of the photosensitive drum 12 along the axial direction and with the second side plate 31B supporting the other end of the photosensitive drum 12 along the axial direction, the drum frame 31 supports the photosensitive drum 12.

The handle 32 is held by the user when the drum cartridge 3 is installed into the casing 2 or when the drum cartridge 3 is removed from the casing 2. The handle 32 has a first arm 33A, a second arm 33B, and a connecting portion 34.

The first arm 33A is fitted on the first side plate 31A of the drum frame 31. The first arm 33A extends in a radial direction of the photosensitive drum 12. The first arm 33A is rotatable or revolvable about the drum frame 31. The first arm 33A is rotatable about the rotation axis A of the photosensitive drum 12.

The second arm 33B is distanced from the first arm 33A along the axial direction. The second arm 33B is positioned at the opposite side from the first arm 33A with respect to the drum frame 31 along the axial direction. The second arm 33B is fitted on the second side plate 31B of the drum frame 31. The second arm 33B extends in the radial direction of the photosensitive drum 12. The second arm 33B is rotatable with respect to the drum frame 31. The second arm 33B is rotatable about the rotation axis A of the photosensitive drum 12.

The connecting portion 34 connects the first arm 33A and the second arm 33B. The connecting portion 34 is spaced from the drum frame 31 along the radial direction of the photosensitive drum 12. The connecting portion 34 extends along the axial direction. The connecting portion 34 has a grip 35.

The grip 35 is a part of the connecting portion 34. The grip 35 is positioned at the center of the connecting portion 34 along the axial direction. The grip 35 extends along the axial direction.

Figure 4:
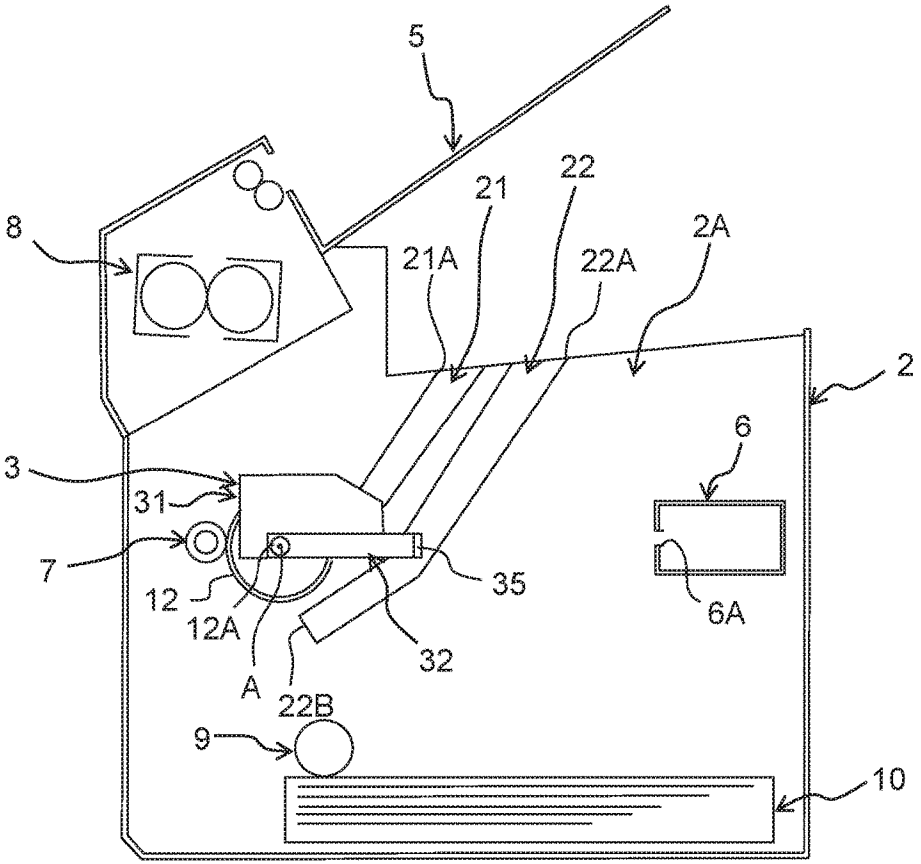
FIG. 4 is an explanatory diagram for explaining a state of the drum cartridge being installed in the casing and the developing cartridge being removed from the casing.
Figure 5:
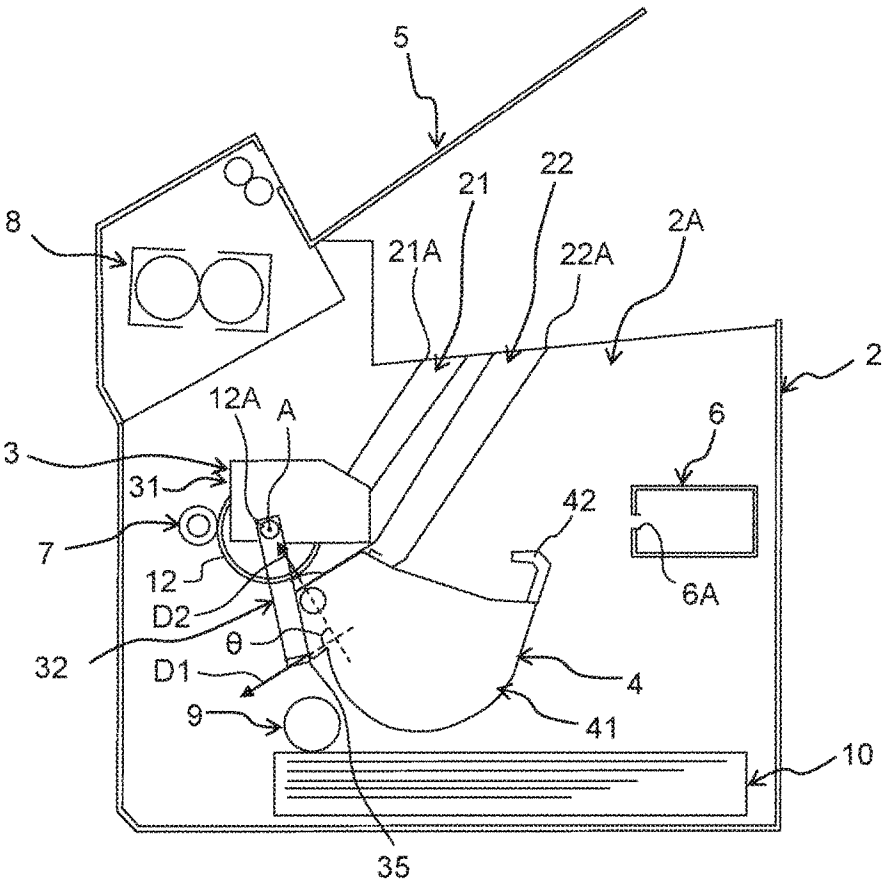
FIG. 5 is an explanatory diagram for explaining a state of the drum cartridge and the developing cartridge being installed in the casing.

As depicted in FIGS. 4 and 5, the handle 32 is movable between a first position (see FIG. 4) and a second position (see FIG. 5). The second position is farther away from the opening 2A than the first position. In detail, the handle 32 is fitted on the drum frame 31. The handle 32 is rotatable with respect to the drum frame 31 between the first position and the second position. The handle 32 is rotatable about the rotation axis A of the photosensitive drum 12. Note that the revolving center for the handle 32 may be positioned between the rotation axis A of the photosensitive drum 12 and the developing cartridge 4 with the drum cartridge 3 and the developing cartridge 4 being installed in the casing 2.

Figure 7:
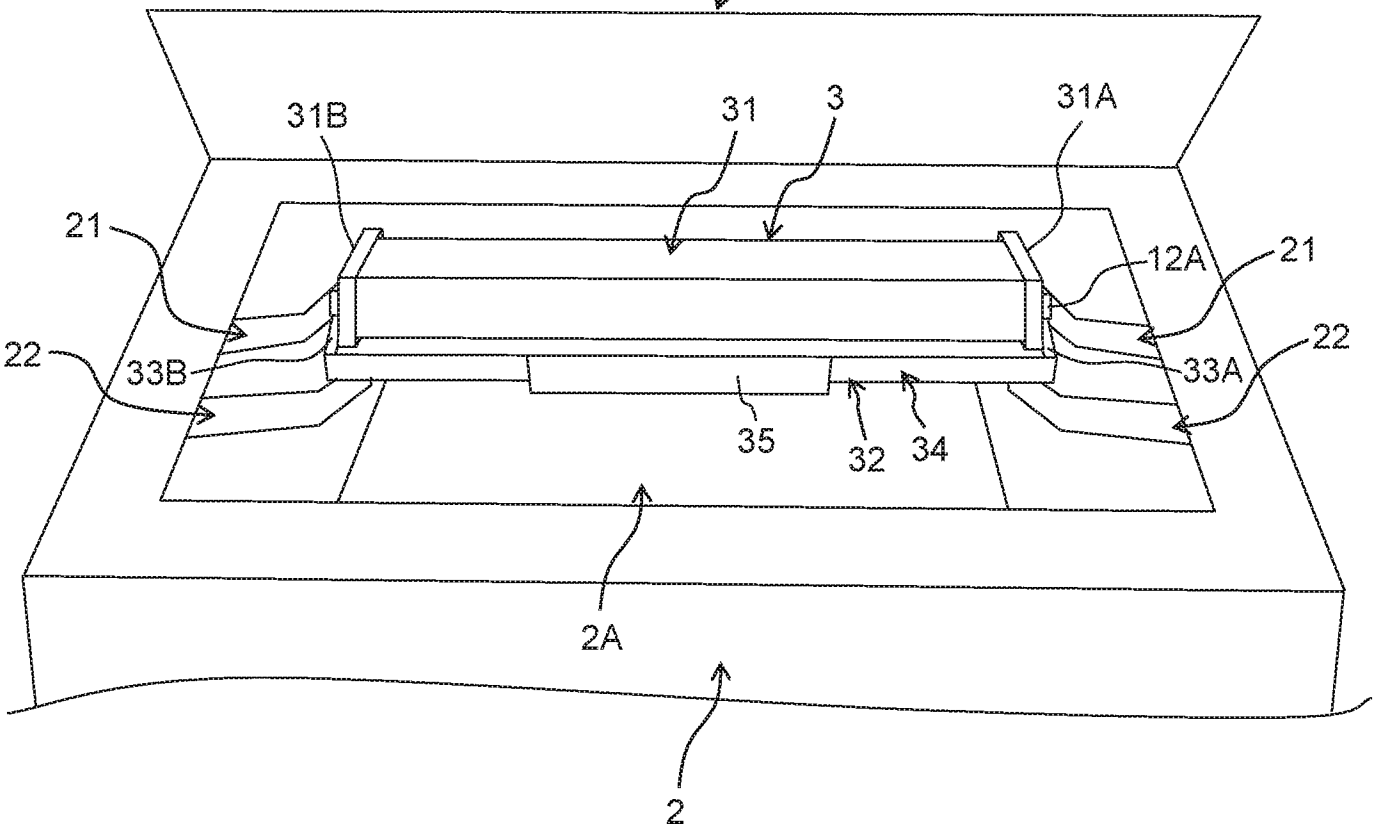
FIG. 7 is a perspective view of the casing and the drum cartridge depicted in FIG. 4.

As depicted in FIG. 4, with the drum cartridge 3 being installed in the casing 2 and with the developing cartridge 4 being removed from the casing 2, the handle 32 locates at the first position. Being pressed by an undepicted spring, the handle 32 is kept at the first position with the drum cartridge 3 being installed in the casing 2 and with the developing cartridge 4 being removed from the casing 2. At the first position, the grip 35 of the handle 32 is positioned between the exposure unit 6 and the photosensitive drum 12. As depicted in FIG. 7, when the handle 32 is at the first position, the user can have a view of the handle 32 through the opening 2A. Further, as depicted in FIG. 4, the handle 32 at the first position overlaps with the developing guide 22 as viewed from the axial direction. Therefore, with the drum cartridge 3 being installed in the casing 2, if the developing cartridge 4 is installed in the casing 2 (see FIG. 1), then the developing cartridge 4 is guided by the developing guide 22 to contact with the handle 32.

Figure 8:
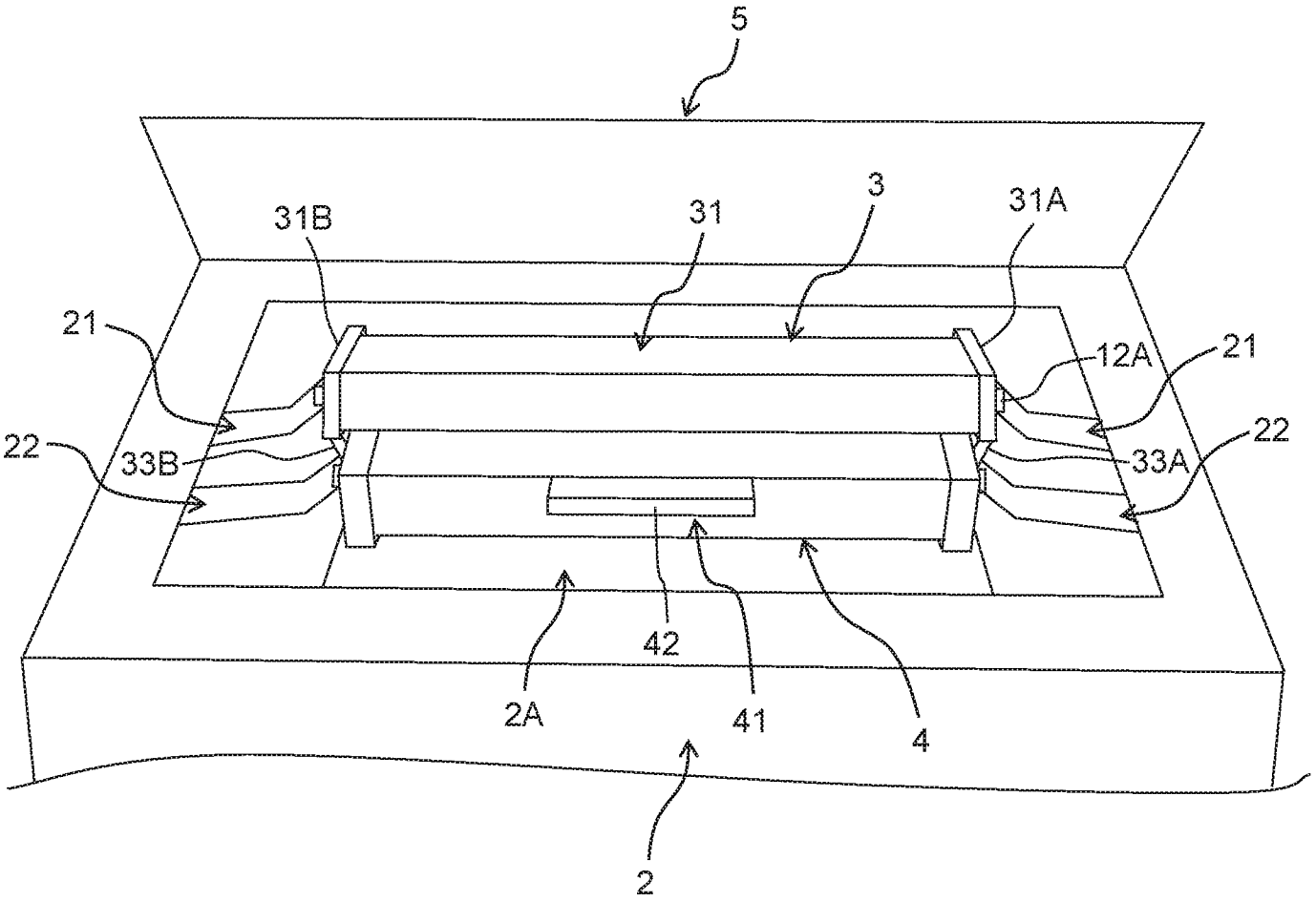
FIG. 8 is a perspective view of the casing, the drum cartridge and the developing cartridge depicted in FIG. 5.

Further, as depicted in FIG. 5, with the drum cartridge 3 and the developing cartridge 4 being installed in the casing 2, being pressed by the developing cartridge 4, the handle 32 locates at the second position in resistance against the force from the undepicted spring. On this occasion, the developing cartridge 4 locates between the handle 32 at the second position and the opening 2A of the casing 2. In other words, the developing cartridge 4 locates between the handle 32 at the second position and the cover 5 at the closed position. The sentence "the developing cartridge 4 locates between the handle 32 at the second position and the cover 5 at the closed position," means that the developing cartridge 4 cuts across any straight line linking the handle 32 at the second position and the cover 5 at the closed position. In detail, the developing cartridge 4 locates between at least part of the handle 32 at the second position and the cover 5 at the closed position. In particular, the developing cartridge 4 is positioned between the grip 35 of handle 32 at the second position and the cover 5 at the closed position. As depicted in FIG. 8, with the drum cartridge 3 and the developing cartridge 4 being installed in the casing 2, the handle 32 is covered by the developing cartridge 4. By virtue of this, when the user is viewing the inside of the casing 2 through the opening 2A, the handle 32 is hidden by the developing cartridge 4 and thus is difficult to see from the user.

<The Developing Cartridge 4>

Next, details of the developing cartridge 4 will be explained.

As depicted in FIG. 8, the developing cartridge 4 includes the aforementioned developing roller 14 (see FIG. 1) and a developing frame 41.

Figure 6:
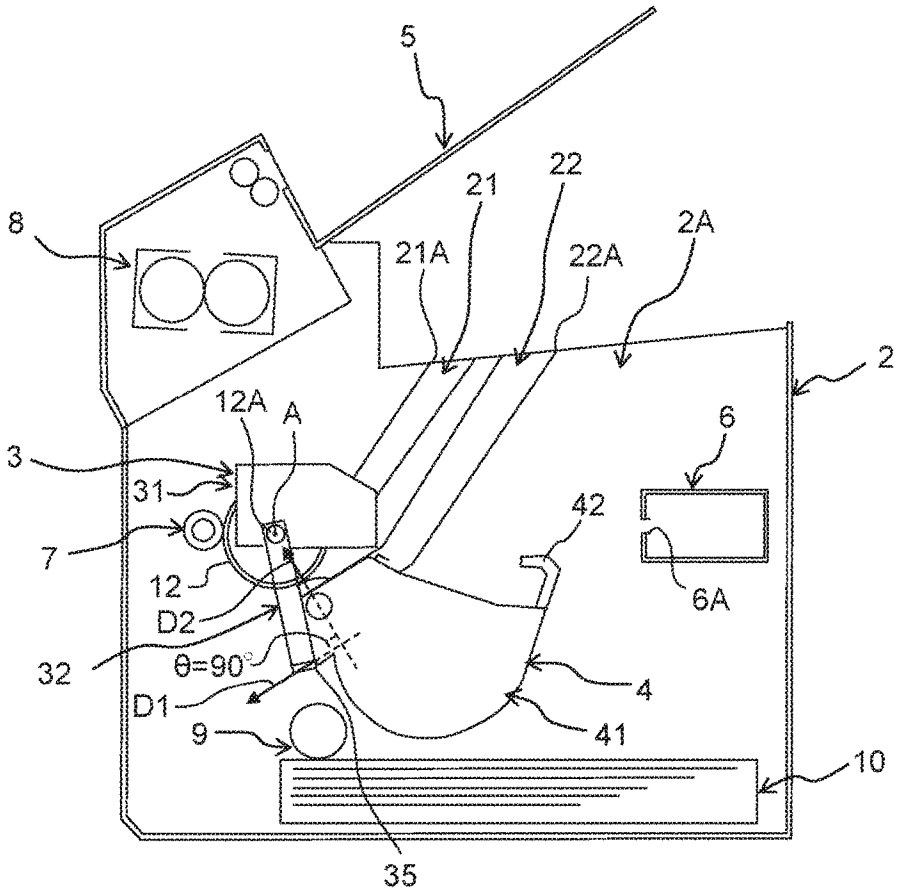
FIG. 6 is an explanatory diagram in which the first pressing direction D1 is orthogonal to the second pressing direction D2.

The developing frame 41 accommodates toner. Further, the developing frame 41 rotatably supports the developing roller 14. The developing frame 41 extends in the axial direction. The developing frame 41 has a cylindrical shape. As depicted in FIG. 5, with the developing cartridge 4 being installed in the casing 2, part of the developing frame 41 is in contact with the handle 32 of the drum cartridge 3. By virtue of this, being installed in the casing 2, the developing cartridge 4 presses the handle 32 of the drum cartridge 3 from the first position toward the second position, in resistance against the force from the undepicted spring on the handle 32. A first pressing direction D1 for the developing cartridge 4 to press the handle 32 therein intersects a second pressing direction D2 for the developing roller 14 to press the photosensitive drum 12 therein. The first pressing direction D1 and the second pressing direction D2 form an angle θ which is larger than 45° but not larger than 90°. By forming the angle θ larger than 45° but not larger than 90° between the first pressing direction D1 and the second pressing direction D2, it is possible to reduce the influence from the force received by the developing cartridge 4 from the undepicted spring via the handle 32, to the force for pressing the developing roller 14 against the photosensitive drum 12. The first pressing direction D1 may be orthogonal to the second pressing direction D2 as depicted in FIG. 6. Further, the developing frame 41 has a grip 42.

As depicted in FIG. 8, the grip 42 projects from the developing frame 41. The grip 42 is positioned at the center of the developing frame 41 along the axial direction. The grip 42 extends in the axial direction. With the drum cartridge 3 and the developing cartridge 4 being installed in the casing 2, the grip 42 is positioned between the drum cartridge 3 and the exposure unit 6 (see FIG. 5) along the horizontal direction. With the drum cartridge 3 and the developing cartridge 4 being installed in the casing 2, the user can have a view of the grip 42 through the opening 2A. With the drum cartridge 3 and the developing cartridge 4 being installed in the casing 2, the handle 32 of the drum cartridge 3 is difficult to see from the user through the opening 2A whereas the grip 42 of the developing cartridge 4 is easy to see from the user through the opening 2A. Further, to easily draw the user's attention, the grip 42 may have a color different from that of the drum frame 31 and the developing frame 41.

Functions and Effects of this Embodiment

According to the image forming apparatus 1, as depicted in FIGS. 5 and 7, with the drum cartridge 3 and the developing cartridge 4 being installed in the casing 2, the handle 32 of the drum cartridge 3 is positioned to the second position by the developing cartridge 4, and thus distanced from the opening 2A.

Therefore, when viewing the inside of the casing 2 through the opening 2A, the user is less likely to find the handle 32 of the drum cartridge 3.

By virtue of this, with the drum cartridge 3 and the developing cartridge 4 being installed in the casing 2, it is possible to draw the user's attention to the developing cartridge 4 but not to the handle 32 of the drum cartridge 3.

As a result, with the drum cartridge 3 and the developing cartridge 4 being installed in the casing 2, the user can reliably select the developing cartridge 4 and remove the same.

Further, as depicted in FIG. 7, after removing the developing cartridge 4 from the casing 2, the user can easily find the handle 32 at the first position.

By virtue of this, after removing the developing cartridge 4 from the casing 2, the user can get a hold of the handle 32 at the first position to remove the drum cartridge 3 from the casing 2.

Second Embodiment

Next, a second embodiment will be explained. In the second embodiment, the same numerals or alpha-numerals are assigned to the same members as those in the first embodiment, and any explanation therefor will be omitted.

In the second embodiment, a handle 51 is slidable against the drum frame 31 between the first position and the second position.

Figure 9:
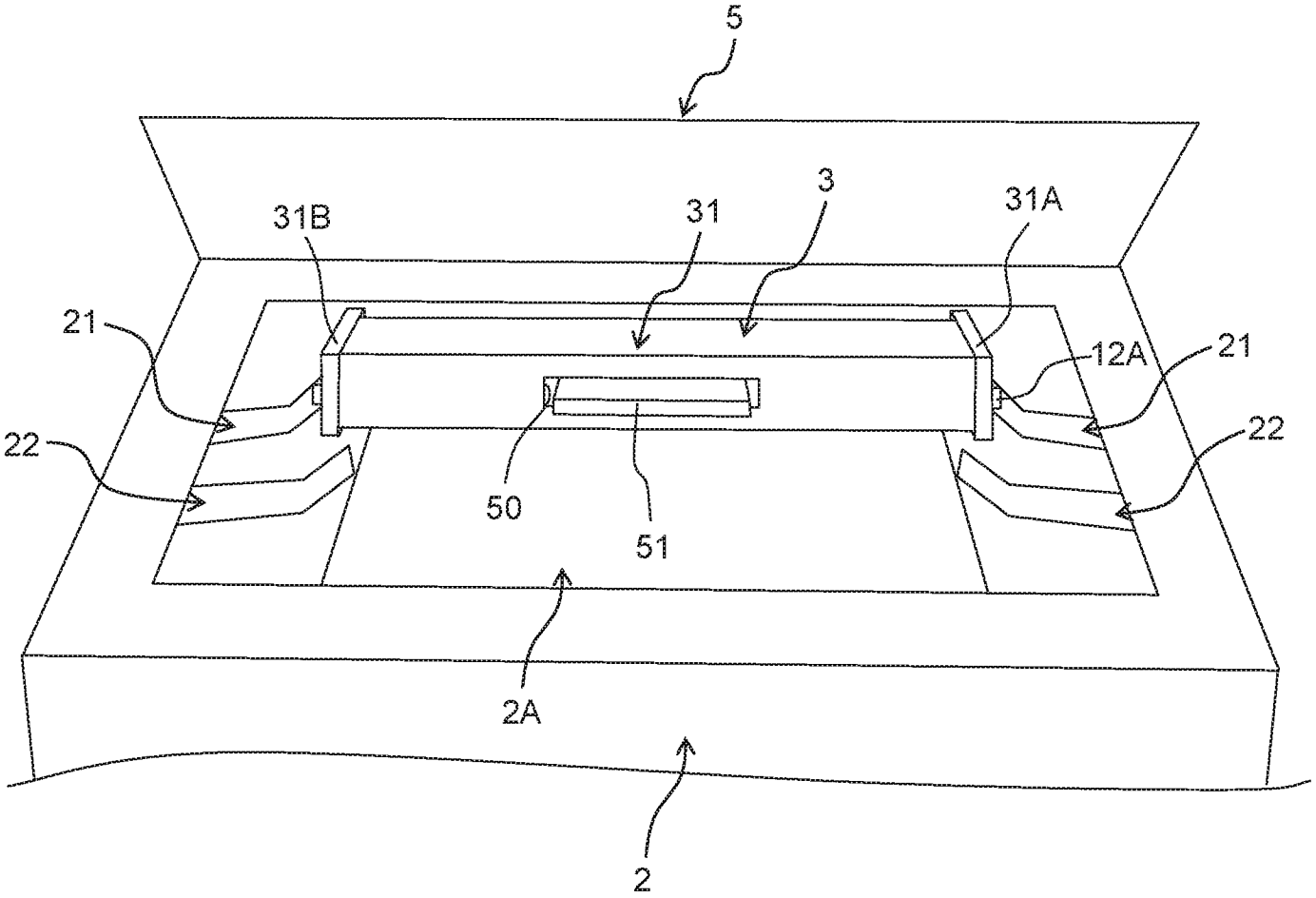
FIG. 9 is an explanatory diagram for explaining a second embodiment, showing a state of the drum cartridge being installed in the casing and the developing cartridge being removed from the casing.

In detail, the handle 51 is, as depicted in FIG. 9, at the first position with the drum cartridge 3 being installed in the casing 2 and with a developing cartridge 52 (see FIG. 10) being removed from the casing 2. At the first position, the handle 51 projects out of the drum frame 31 through an opening 50 provided in the drum frame 31.

Figure 10:
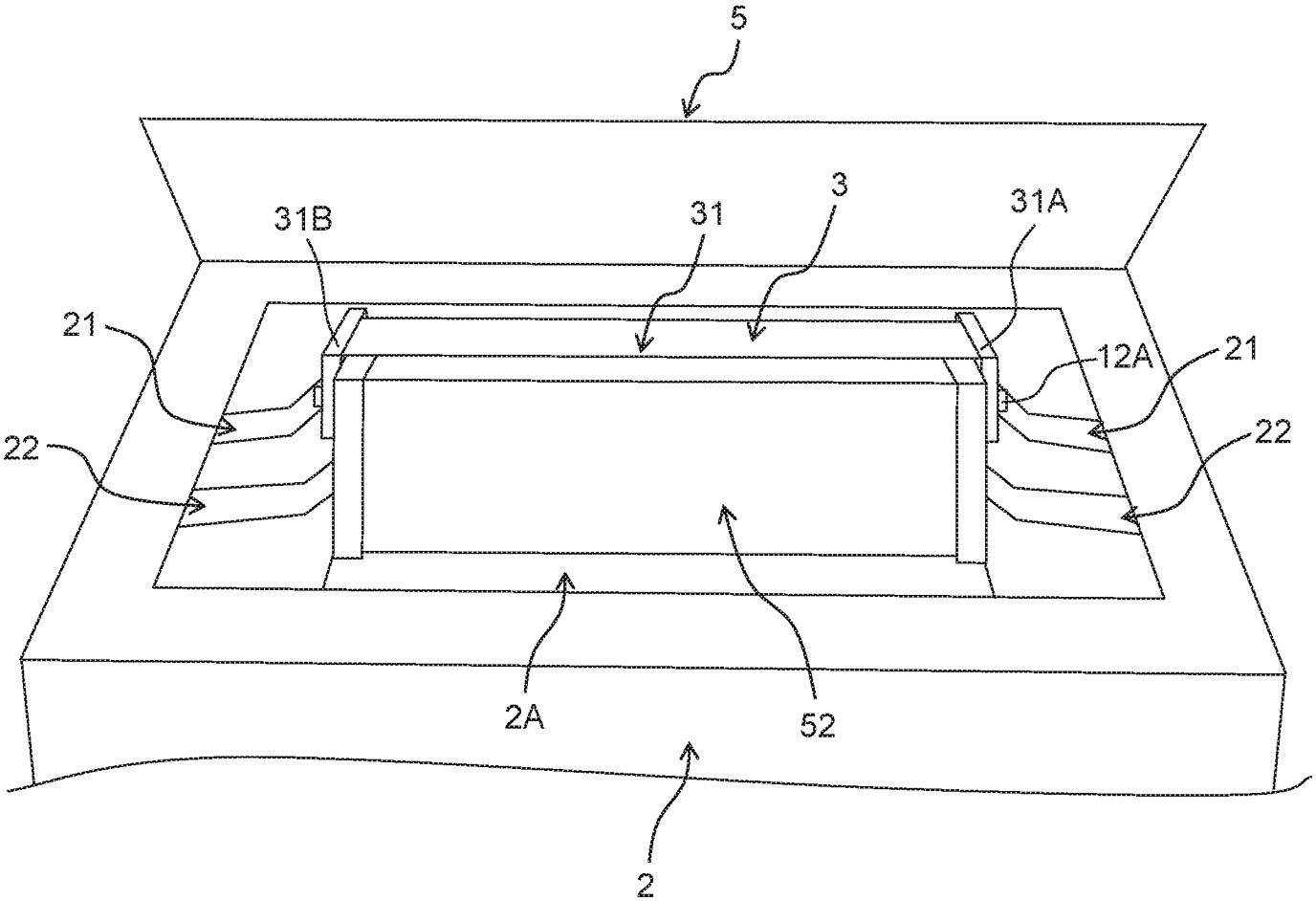
FIG. 10 is an explanatory diagram for explaining the second embodiment together with FIG. 9, showing a state of the drum cartridge and the developing cartridge being installed in the casing.

Further, as depicted in FIG. 10, with the drum cartridge 3 and the developing cartridge 52 being installed in the casing 2, the handle 51 is covered by part of the developing cartridge 52. On this occasion, being pressed by that part of the developing cartridge 52, the handle 51 slides against the drum frame 31 to locate at the second position which is displaced into the drum frame 31 from the first position. At the second position, the handle 51 is farther away from the opening 2A than at the first position. With the drum cartridge 3 and the developing cartridge 52 being installed in the casing 2, being covered by the part of the developing cartridge 52, the handle 51 is not viewable from the user through the opening 2A. By virtue of this, with the drum cartridge 3 and the developing cartridge 52 being installed in the casing 2, it is possible to draw the user's attention to the developing cartridge 52 but not to the handle 51 of the drum cartridge 3.

According to the second embodiment, it is also possible to obtain the same functions and effects as the first embodiment.

Third Embodiment

Next, a third embodiment will be explained. In the third embodiment, the same numerals or alpha-numerals are assigned to the same members as those in the second embodiment, and any explanation therefor will be omitted.

Figure 11:
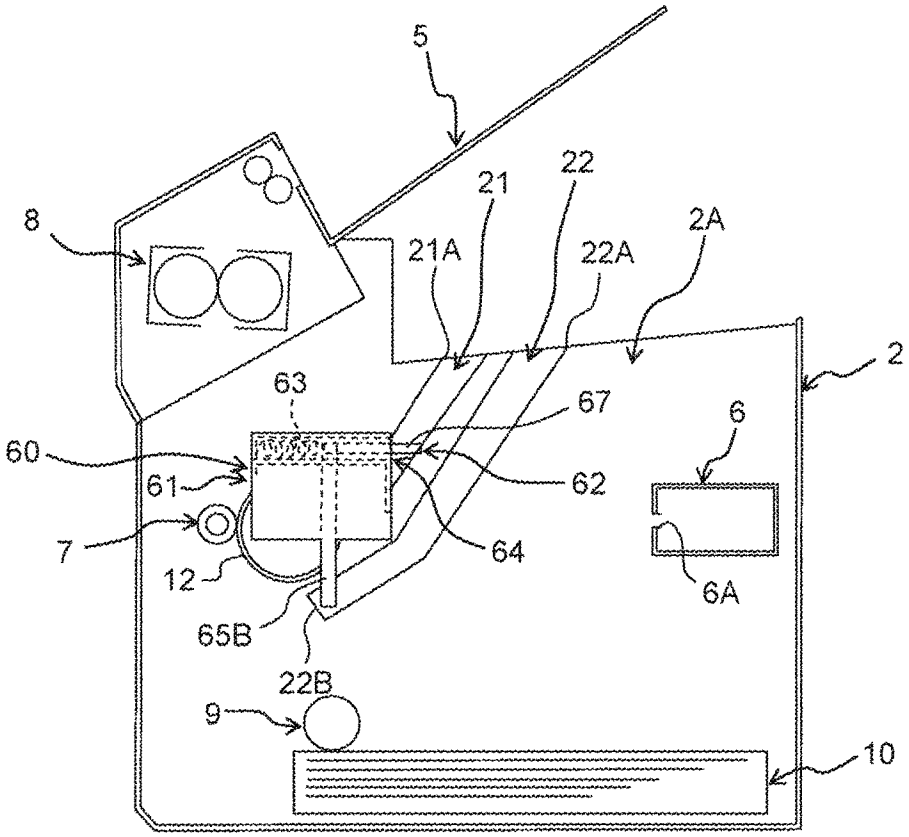
FIG. 11 is an explanatory diagram for explaining a third embodiment, showing a state of the drum cartridge being installed in the casing and the developing cartridge being removed from the casing.

In the third embodiment, as depicted in FIG. 11, with the drum cartridge 3 being installed in the casing 2 and with the developing cartridge 4 being removed from the casing 2, at least part of a handle 62 locates at the first position outside the drum frame 31. In detail, with the handle 62 at the first position, at least a grip 67 is at the outside of the drum frame 31.

Figure 12:
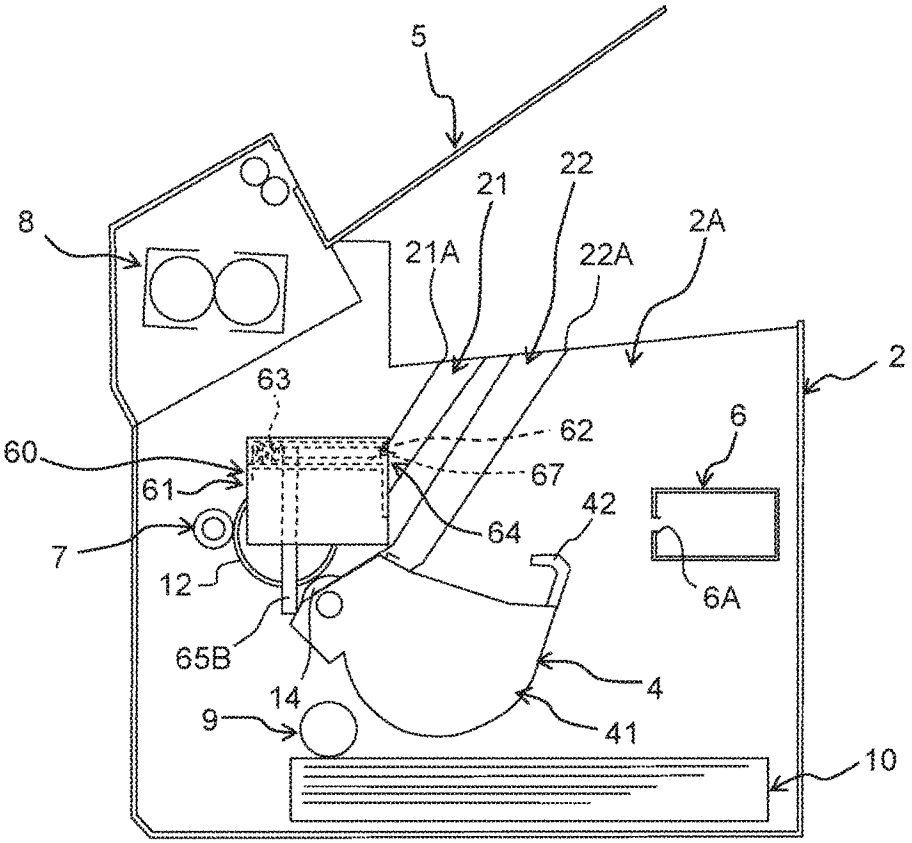
FIG. 12 is an explanatory diagram for explaining the third embodiment together with FIG. 11, showing a state of the drum cartridge and the developing cartridge being installed in the casing.

Further, as depicted in FIG. 12, with the drum cartridge 3 and the developing cartridge 4 being installed in the casing 2, being pressed by the developing cartridge 4, the handle 62 is entirely located at the second position on the inside of the drum frame 31.

The third embodiment will be explained below in detail.

<Drum Cartridge 60>

A drum cartridge 60 has a drum frame 61, the handle 62, and a pressing member 63.

Figure 13:
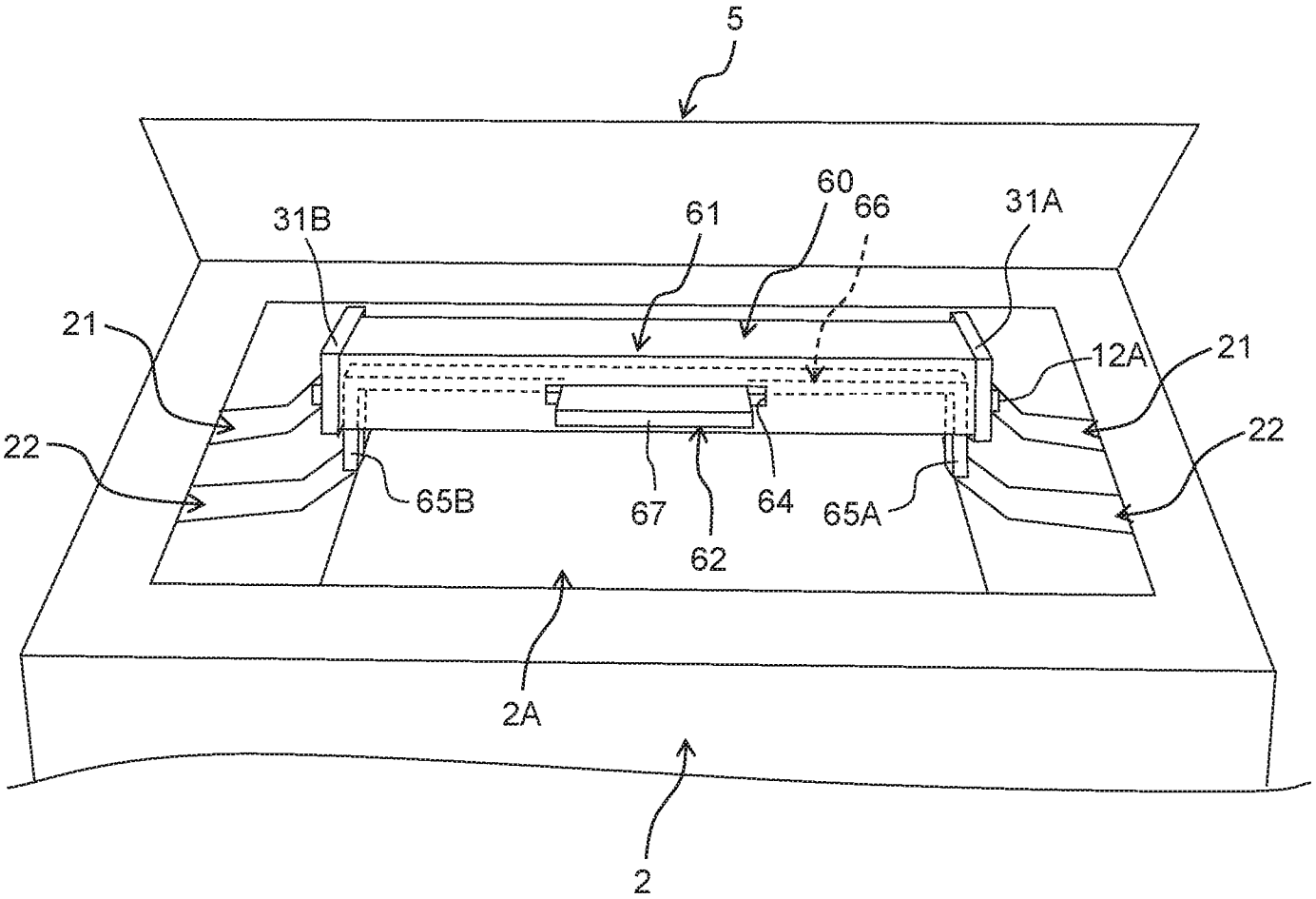
FIG. 13 is a perspective view of the casing and the drum cartridge and depicted in FIG. 11.

As depicted in FIG. 13, the drum frame 61 has an opening 64.

The opening 64 is positioned at the center of the drum frame 61. The opening 64 extends in the axial direction.

The handle 62 has a contact portion 65A, a second contact portion 65B, and a connecting portion 66.

With the developing cartridge 4 being installed in the casing 2, the contact portion 65A is in contact with a third contact portion 68A (see FIG. 15) of the developing cartridge 4. The third contact portion 68A will be described later on. The contact portion 65A is positioned between the first side plate 31A and the opening 64 of the drum frame 61. The contact portion 65A extends in the radial direction of the photosensitive drum 12. The contact portion 65A projects from the drum frame 61. The contact portion 65A has a rod-like shape.

With the developing cartridge 4 being installed in the casing 2, the second contact portion 65B is in contact with a fourth contact portion 68B (see FIG. 15) of the developing cartridge 4. The fourth contact portion 68B will be described later on. The second contact portion 65B is positioned apart from the contact portion 65A along the axial direction. The second contact portion 65B is positioned at the opposite side from the contact portion 65A with respect to the opening 64 along the axial direction. The second contact portion 65B is positioned between the second side plate 31B and the opening 64 of the drum frame 61. The second contact portion 65B extends in the radial direction of the photosensitive drum 12. The second contact portion 65B projects from the drum frame 61. The second contact portion 65B has a rod-like shape.

The connecting portion 66 connects the contact portion 65A and the second contact portion 65B. The connecting portion 66 extends in the axial direction. The connecting portion 66 has a grip 67.

Figure 14:
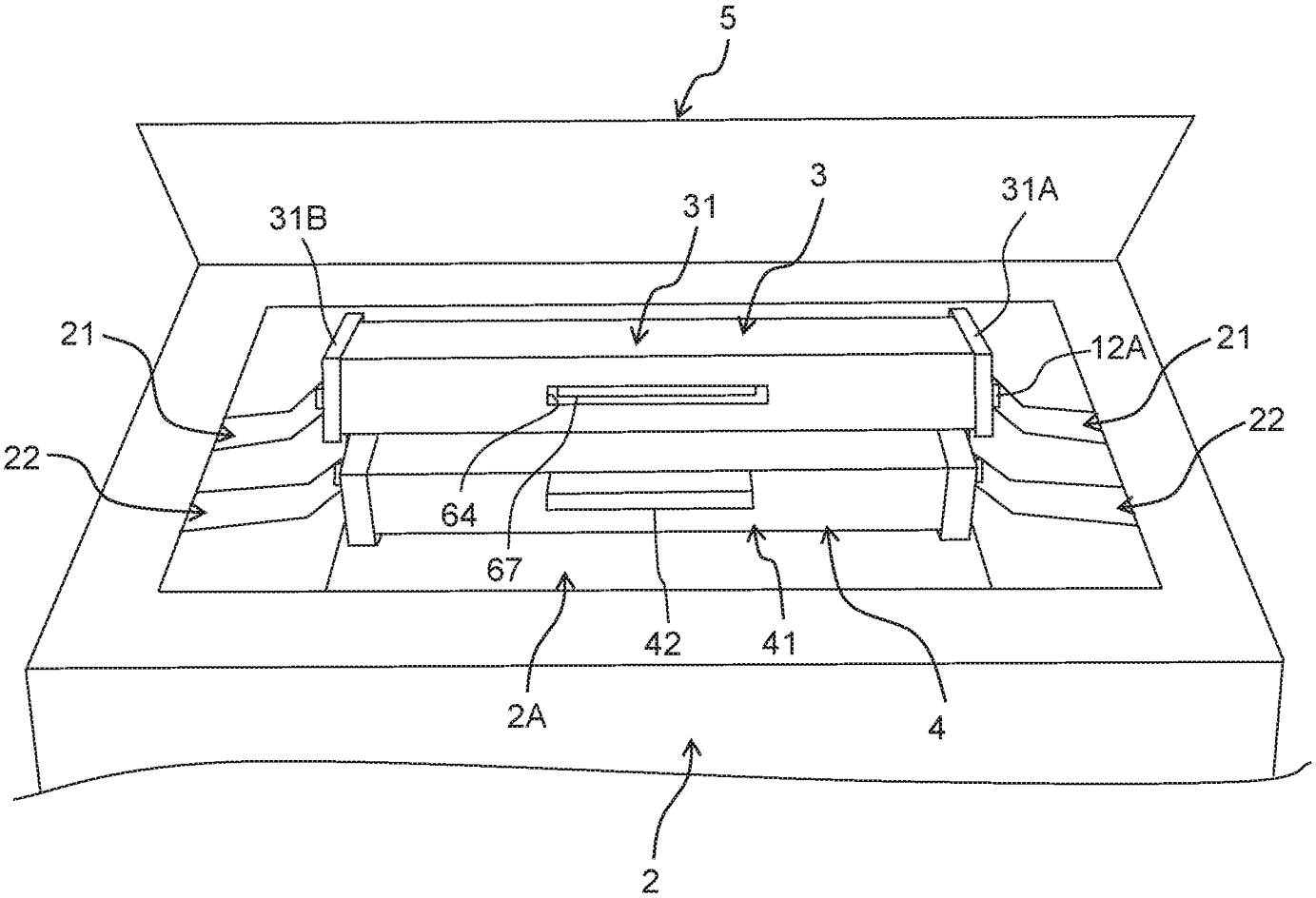
FIG. 14 is a perspective view of the casing, the drum cartridge and the developing cartridge depicted in FIG. 12.

The grip 67 is a part of the connecting portion 66. The grip 67 is positioned at the center of the connecting portion 66 along the axial direction. The grip 67 extends in the axial direction. With the handle 62 at the first position, the grip 67 projects from the drum frame 61 through the opening 64. The grip 67 has a different color from the drum frame 61. That is, the handle 62 has a different color from the drum frame 61. By virtue of this, at the first position, the handle 62 draws the user's attention readily. Further, as depicted in FIG. 14, with the handle 62 at the second position, the grip 67 is accommodated in the drum frame 61.

As depicted in FIGS. 10 and 11, the pressing member 63 presses the handle 62 at the second position toward the first position. With the drum cartridge 60 being installed in the casing 2 and the developing cartridge 4 being removed from the casing 2, the pressing member 63 positions the handle 62 to the first position. With the handle 62 at the first position, at least the grip 67 is outside of the drum frame 61. By virtue of this, it is easier for the user to understand that taking hold of the grip 67 can remove the drum cartridge 60 from the casing 2. In particular, the pressing member 63 is a compression spring.

Figure 15:
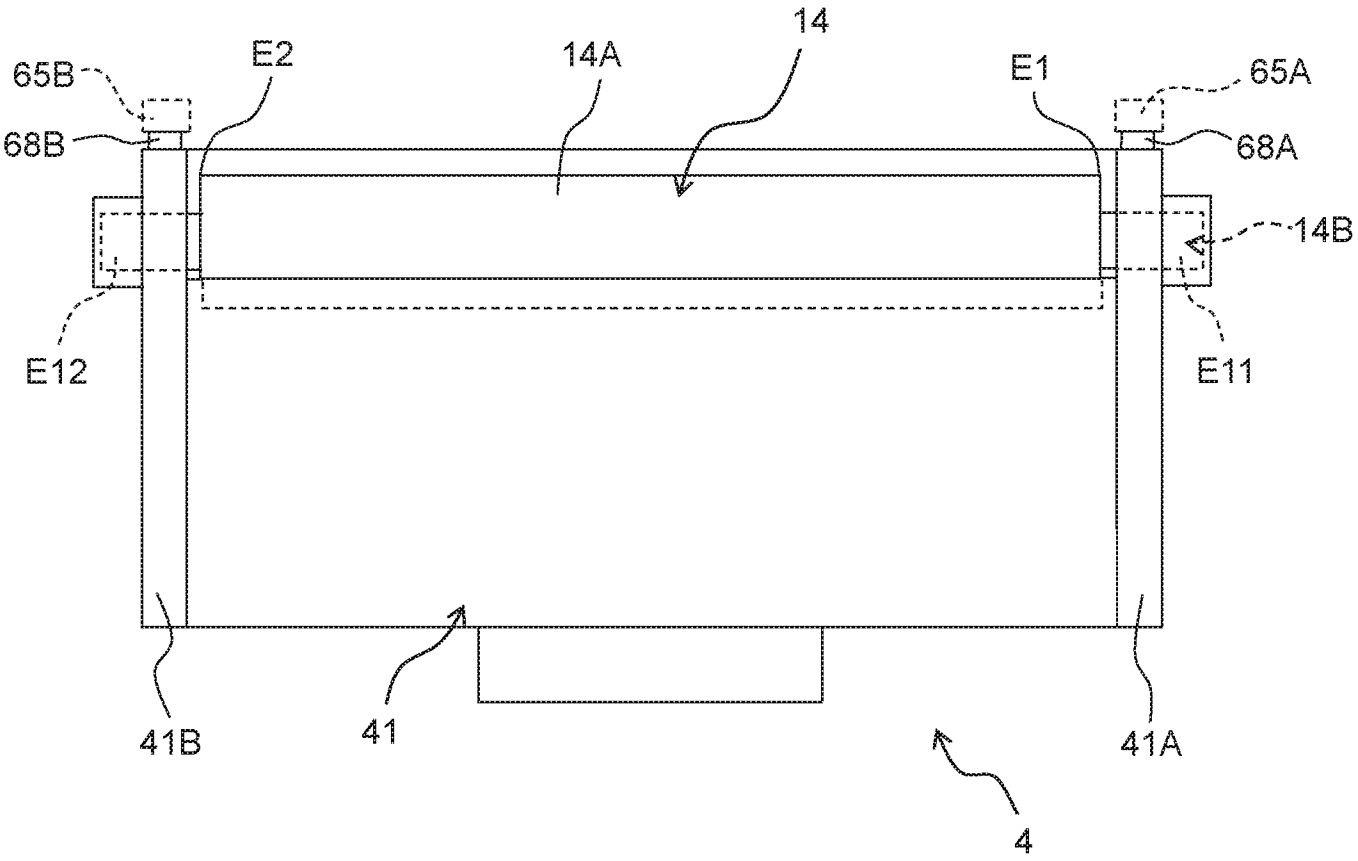
FIG. 15 is a plan view of the developing cartridge depicted in FIG. 14.

As depicted in FIG. 15, the developing cartridge 4 includes the aforementioned developing roller 14, the aforementioned developing frame 41, the third contact portion 68A, and the fourth contact portion 68B.

The developing roller 14 includes a developing roller body 14A and a developing roller shaft 14B.

With the drum cartridge 3 and the developing cartridge 4 being installed in the casing 2, the developing roller body 14A is in contact with the surface of the photosensitive drum 12. The developing roller body 14A is positioned between a side plate 41A and a side plate 41B of the developing frame 41. The side plate 41A and the side plate 41B will be explained later on. The developing roller body 14A extends in the axial direction. The developing roller body 14A has a cylindrical shape. The developing roller body 14A has an end E1 along the axial direction and another end E2 apart from the end E1 along the axial direction. With the drum cartridge 3 and the developing cartridge 4 being installed in the casing 2, the end E1 of the developing roller body 14A is positioned between the end E2 of the developing roller body 14A and the contact portion 65A of the handle 62. With the drum cartridge 3 and the developing cartridge 4 being installed in the casing 2, the end E2 of the developing roller body 14A is positioned between the end E1 of the developing roller body 14A and the second contact portion 65B of the handle 62 along the axial direction.

The developing roller shaft 14B extends in the axial direction. In detail, the developing roller shaft 14B extends along the rotation axis of the developing roller 14. The developing roller shaft 14B has a cylindrical shape. The developing roller shaft 14B has an end E11 along the axial direction and another end E12 along the axial direction. The end E11 of the developing roller shaft 14B is rotatably supported by the side plate 41A of the developing frame 41. The end E11 of the developing roller shaft 14B is rotatably supported by the side plate 41B of the developing frame 41.

The developing frame 41 includes the side plate 41A and the side plate 41B along the axial direction.

The side plate 41A supports one end of the developing roller 14 along the axial direction. In detail, the side plate 41A rotatably supports the end E11 of the developing roller shaft 14B along the axial direction.

The side plate 41B is spaced from the side plate 41A along the axial direction. The side plate 41B supports the other end of the developing roller 14 along the axial direction. In detail, the side plate 41B rotatably supports the end E12 of the developing roller shaft 14B along the axial direction. With the side plate 41A supporting the one end of the developing roller 14 along the axial direction and with the developing roller shaft 14B supporting the other end of the developing roller 14 along the axial direction, the developing frame 41 supports the developing roller 14.

With the developing cartridge 4 being installed in the casing 2, the third contact portion 68A is in contact with the contact portion 65A of the handle 62. The third contact portion 68A may be either a part of the developing frame 41 or made from another member than the developing frame 41 and fitted on the developing frame 41. In the third embodiment, the third contact portion 68A is a projection. The third contact portion 68A projects from the side plate 41A. The third contact portion 68A is positioned at the opposite side from the end E2 of the developing roller body 14A with respect to the end E1 of the developing roller body 14A along the axial direction.

With the developing cartridge 4 being installed in the casing 2, the fourth contact portion 68B is in contact with the second contact portion 65B of the handle 62. The fourth contact portion 68B may be either a part of the developing frame 41 or made from another member than the developing frame 41 and fitted on the developing frame 41. In the third embodiment, the fourth contact portion 68B is a projection. The fourth contact portion 68B projects from the side plate 41B. The fourth contact portion 68B is positioned at the opposite side from the end E1 of the developing roller body 14A with respect to the end E2 of the developing roller body 14A along the axial direction.

As depicted in FIGS. 10 and 11, with the developing cartridge 4 being installed in the casing 2, the third contact portion 68A (see FIG. 15) presses the contact portion 65A of the handle 62 while the fourth contact portion 68B (see FIG. 15) presses the second contact portion 65B of the handle 62 such that the handle 62 is pressed by the developing cartridge 4. By virtue of this, resisting the pressing force from the pressing member 63, the handle 62 is located at the second position. With the handle 62 at the second position, the whole handle 62 is inside the drum frame 31. With the drum cartridge 60 and the developing cartridge 4 being installed in the casing 2, the handle 62 is positioned inside the drum frame 31 so as for the user to see the same less easily through the opening 2A. By virtue of this, with the drum cartridge 60 and the developing cartridge 4 being installed in the casing 2, it is possible to draw the user's attention to the developing cartridge 4 but not to the handle 62 of the drum cartridge 60.

It is also possible for the third embodiment to obtain similar functions and effects to the first embodiment.

The embodiments disclosed hereinabove are exemplary but not restrictive in each and every aspect. The image forming apparatus according to the present disclosure is not limited to the above embodiments but may be applied to by various changes and modifications without departing from the true scope and spirit of the present disclosure. For example, the image forming apparatus according to the present disclosure is not limited to the application to a printer but is also applicable to a facsimile apparatus, a photocopier, a multifunction peripheral, and the like. Further, it is possible to combine the technical features stated in the respective embodiments with each other.

What is claimed is:

1. An image forming apparatus comprising:

a casing including a drum guide, a developing guide, and an opening formed in the casing;

a drum cartridge including a photosensitive drum and a handle being movable between a first position and a second position, the drum cartridge being installable into the casing through the opening by the drum guide; and a developing cartridge including a developing roller, the developing cartridge being installable into the casing through the opening by the developing guide, the developing cartridge being removable from the casing, wherein the developing guide is longer than the drum guide, wherein in a case that the drum cartridge is installed in the casing and that the developing cartridge is removed from the casing, the handle locates at the first position, and wherein in a case that the drum cartridge and the developing cartridge are installed in the casing, the handle locates at the second position farther away from the opening than the first position, by being pressed by the developing cartridge.

2. The image forming apparatus according to claim 1, wherein in a case that the drum cartridge and the developing cartridge are installed in the casing, the developing cartridge locates between the handle at the second position and the opening of the casing.

3. The image forming apparatus according to claim 1, wherein the handle at the first position overlaps with the developing guide as viewed from an axial direction along which a rotation axis of the photosensitive drum extends.

4. The image forming apparatus according to claim 1, wherein the drum cartridge includes a drum frame supporting the photosensitive drum, and the handle is rotatable with respect to the drum frame between the first position and the second position.

5. The image forming apparatus according to claim 4, wherein the handle includes a first arm, a second arm and a connecting portion connecting the first arm and the second arm, wherein the second arm is positioned away from the first arm in an axial direction along which a rotation axis of the photosensitive drum extends, and the second arm is located between the first arm and the second arm in the axial direction.

6. The image forming apparatus according to claim 4, wherein the handle is rotatable with respect to a rotation axis of the photosensitive drum.

7. The image forming apparatus according to claim 4, wherein in a case that the drum cartridge and the developing cartridge are installed in the casing, a rotational center of the handle is positioned between a rotation axis of the photosensitive drum and the developing cartridge.

8. The image forming apparatus according to claim 5, further comprising an exposure unit configured to expose the photosensitive drum, wherein the connecting portion of the handle includes a grip and, in a case that the handle is located at the first position, the grip locates between the exposure unit and the photosensitive drum.

9. The image forming apparatus according to claim 1, wherein a first pressing direction in which the developing cartridge presses the handle intersects a second pressing direction in which the developing roller presses the photosensitive drum at an intersecting angle, and the intersecting angle between the first pressing direction and the second pressing direction is larger than 45° and not larger than 90°.

10. The image forming apparatus according to claim 1, wherein the drum cartridge includes a drum frame supporting the photosensitive drum, and the handle is slidable against the drum frame between the first position and the second position.

11. An image forming apparatus comprising:

a casing including a drum guide, a developing guide, and an opening formed in the casing;

a drum cartridge including:

a photosensitive drum;

a drum frame accommodating the photosensitive drum; and a handle movable between a first position and a second position, the drum cartridge being installable into the casing through the opening by the drum guide; and a developing cartridge including a developing roller, the developing cartridge being installable into the casing through the opening by the developing guide, the developing cartridge being removable from the casing, wherein the developing guide is longer than the drum guide; and wherein in a case that the drum cartridge is installed in the casing and that the developing cartridge is removed from the casing, the handle locates at the first position at which at least part of the handle is outside of the drum frame, and wherein the drum cartridge and the developing cartridge are installed in the casing, the handle locates at the second position at which the handle is located inside of the drum frame entirely, by being pressed by the developing cartridge.

12. The image forming apparatus according to claim 11, wherein the drum cartridge includes a pressing member configured to press the handle at the second position toward the first position.

13. The image forming apparatus according to claim 11, wherein the handle includes a contact portion configured to contact with the developing cartridge in a case that the developing cartridge is installed into the casing, wherein the developing roller includes a developing roller shaft and a main body of the developing roller, the main body of the developing roller having one end along an axial direction along which a rotation axis of the photosensitive drum extends, and an other end apart from the one end along the axial direction, and wherein the one end of the main body of the developing roller is positioned between the other end of the main body of the developing roller and the contact portion of the handle along the axial direction.

14. The image forming apparatus according to claim 13, wherein the handle includes a second contact portion which is positioned apart from the contact portion along the axial direction, and configured to contact with the developing cartridge in a case that the developing cartridge is installed into the casing, and wherein the other end of the main body of the developing roller is positioned between the one end of the main body of the developing roller and the second contact portion of the handle along the axial direction.

15. The image forming apparatus according to claim 13, wherein the developing cartridge includes a third contact portion configured to contact with the contact portion in a case that the developing cartridge is installed into the casing.

16. The image forming apparatus according to claim 14, wherein the developing cartridge includes a fourth contact portion configured to contact with the second contact portion in a case that the developing cartridge is installed into the casing.

17. The image forming apparatus according to claim 11, wherein a color of the handle is different from a color of the drum frame.

* * * * *